United States Patent [19]

Bako

[11] 3,978,697

[45] Sept. 7, 1976

[54] LATCHING DEVICE

[75] Inventor: Lazlo Bako, Woodcliff Lake, N.J.

[73] Assignee: Presto Lock Company, Division of Walter Kidde & Company, Inc., Elmwood Park, N.J.

[22] Filed: June 5, 1975

[21] Appl. No.: 584,053

[52] U.S. Cl. ..... 70/68; 70/74; 190/41 Z

[51] Int. Cl.[2] ..... E05B 67/30; E05B 65/52

[58] Field of Search ..... 70/68, 74, 73, 67, 66, 70/69, 71, 72, 2–13, 159; 24/205.14 R; 190/41 Z, 48

[56] References Cited

UNITED STATES PATENTS

| | | | |
|---|---|---|---|
| 3,319,743 | 5/1967 | Pelavin | 70/68 X |
| 3,597,945 | 8/1971 | Feinberg | 70/74 |

FOREIGN PATENTS OR APPLICATIONS

| | | | |
|---|---|---|---|
| 188,670 | 4/1956 | Austria | 70/68 |

*Primary Examiner*—Robert L. Wolfe
*Attorney, Agent, or Firm*—Shapiro and Shapiro

[57] ABSTRACT

A latching device for releasibly locking together the two zipper pulls on a double zipper type case includes a frame, a rotatable key barrel projecting from the frame for being received in respective openings in the zipper pulls, a latch member pivotally connected to the frame for movement between a lowered position overlying the frame and a raised position, the latch member having an opening therein for receiving the end of the key barrel when the latch member is in lowered position, and a key-actuatable bolt member supported below the key barrel for sliding movement between the locking and unlocking positions to releasibly lock the latch member in lowered position. The frame is mounted at one end of an elongated mounting plate having its other end constructed to engage a rigid reinforcing member of the case.

16 Claims, 6 Drawing Figures

LATCHING DEVICE

This invention relates to latching devices for releasibly locking therein one or more members having respective openings or eyelets, and is more particularly directed to an improved latching device for releasibly locking together the two zipper pulls of a double zipper type case.

BACKGROUND OF THE INVENTION

Latching devices for releasibly connecting together two elements having openings or eyelets therein, such as perforated straps or the pulls of a double zipper type case, are well known. Such devices particularly include a base plate having an upstanding stud which is adapted to be received by respective openings in the two elements and a latch member which is pivotally connected to the base plate for movement between lowered and raised positions. In its lowered position, the latch member holds the elements against the base plate with their respective openings receiving the stud, whereas in the raised position of the latch member the elements may be removed from or placed on the stud. Latching devices of this type have been provided with key-actuated locking mechanisms for enabling the latch members to be releasibly locked in lowered position, these mechanisms being actuated by a key inserted through a keyhole provided in the latch member. However, the keyhole must be laterally spaced from the projection on the base plate so that insertion of the key is not blocked by the elements which are to be locked together, thereby limiting miniaturization of the latching device.

SUMMARY OF THE INVENTION

It is a principal object of the invention to provide an improved latching device for releasibly locking therein one or more members having respective openings or eyelets therein, the device having an improved and simplified construction which enables the device to be made smaller than prior art latching devices of the same general type.

Another object of the invention is to provide an improved latching device for releasibly locking together a pair of zipper pulls on a luggage case.

Still another object of the invention is to provide a latching device of the above-described type having a mounting plate constructed to engage a rigid reinforcing member of the case, and wherein the position of the mounting plate is adjustable relative to the reinforcing member to enable the latching device to be mounted on cases having different sizes.

A latching device constructed in accordance with the invention includes a base plate, key-receiving means, such as a rotatable key barrel, projecting upwardly from the base plate to be received by an opening in one or more elements to be secured in the latching device, and a latch member pivotally connected to the base plate for movement between a lowered latching position and a raised unlatching position. The latch member has an opening therein in alignment with the key-receiving means when the latch member is in latching position for enabling insertion of a key into the key receiving means to actuate a locking member for releasibly locking the latch member in lowered position.

When the latching device is employed to releasibly lock together the two zipper pulls of a luggage case, the base plate is mounted at one end of a mounting plate having its other end formed to engage a rigid member of the case. In the preferred embodiment, the construction of the mounting plate permits adjustment of the position of the mounting plate relative to the rigid member of the case so that the latching device can be mounted on cases having different sizes.

These, and other advantages are improved results furnished by the latching device of the invention will be apparent from the following detailed description of the illustrated and preferred embodiment of the invention.

DESCRIPTION OF THE PREFERRED EMBODIMENT

Referring to FIGS. 1 – 4, the latching device made in accordance with the invention comprises a base plate or frame A, a projection B, such as a rotatable key barrel, upstanding from the frame and having an opening therein for receiving a key; a latch member C pivotally mounted on the frame for movement between a lowered, latching position overlying the frame and a raised, unlatching position; and a key-actuatable bolt member D movable to locking and unlocking positions for releasably locking the latch member in lowered position. The key-receiving projection B is dimensioned to be received by an opening or eyelet in an element, such as a zipper pull, to be releasably locked in the latching device. When the latch member is in raised position, one or more eyeleted elements may be placed on or removed from the projection. The latch member in the lowered position is cooperable with the end of the projection for preventing removal of the eyeleted element or elements from the device. The latch member has an opening 10 therein in alignment with the end of the projection so that a key can be inserted into the projection to actuate the locking bolt. A leaf spring E is provided for resiliently maintaining the latch member in the raised and lowered positions. Also, the spring is cooperable with the bolt member in the locking and unlocking positions.

Figure 1:
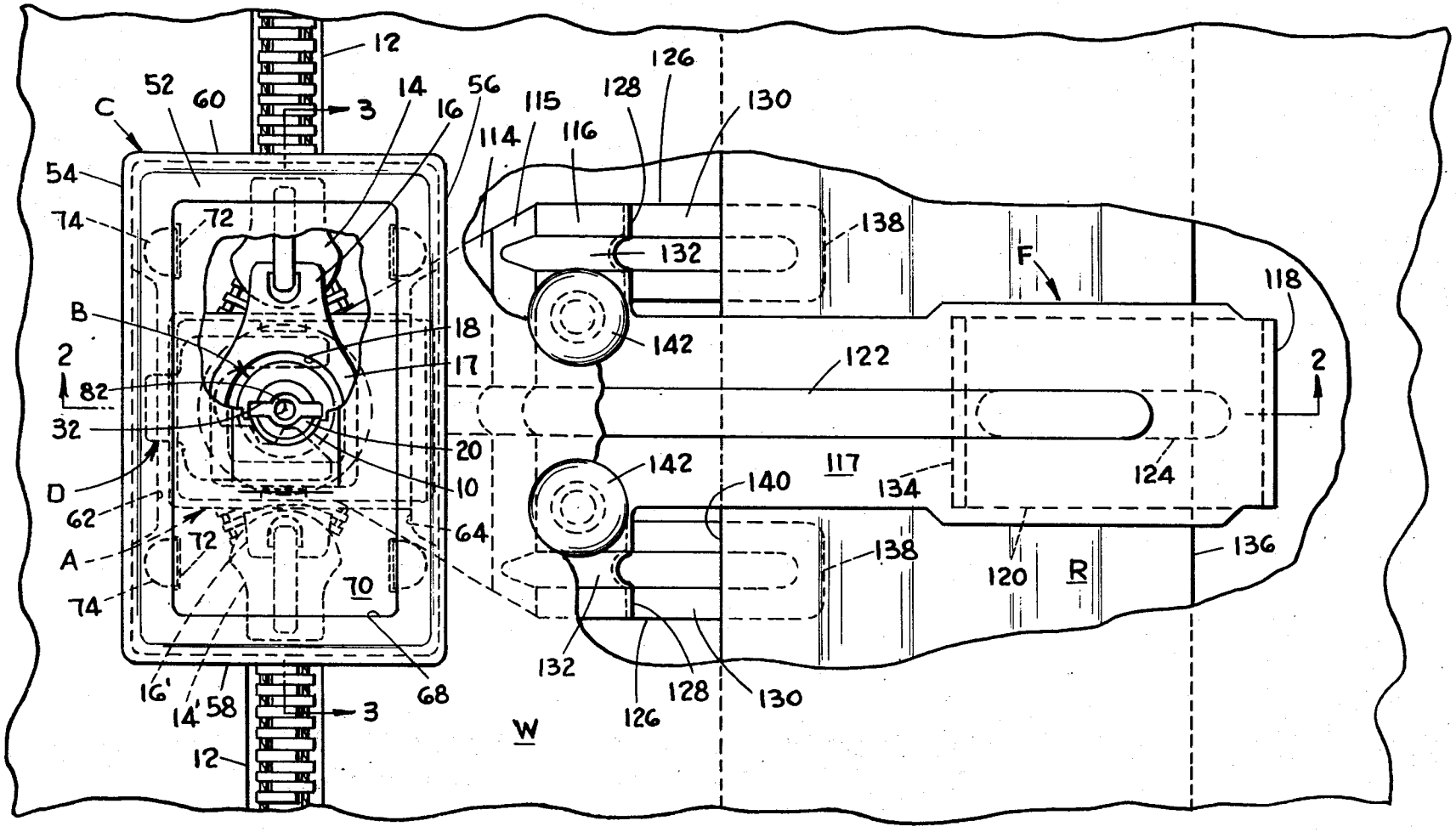
FIG. 1 is a top plan view of a latching device made in accordance with the invention applied to a luggage case having a zipper-type closure, this view showing the latch member locked in latching position, with the latch member being broken away and with one of the zipper pulls being only partly shown for clarity of illustration.
Figure 2:
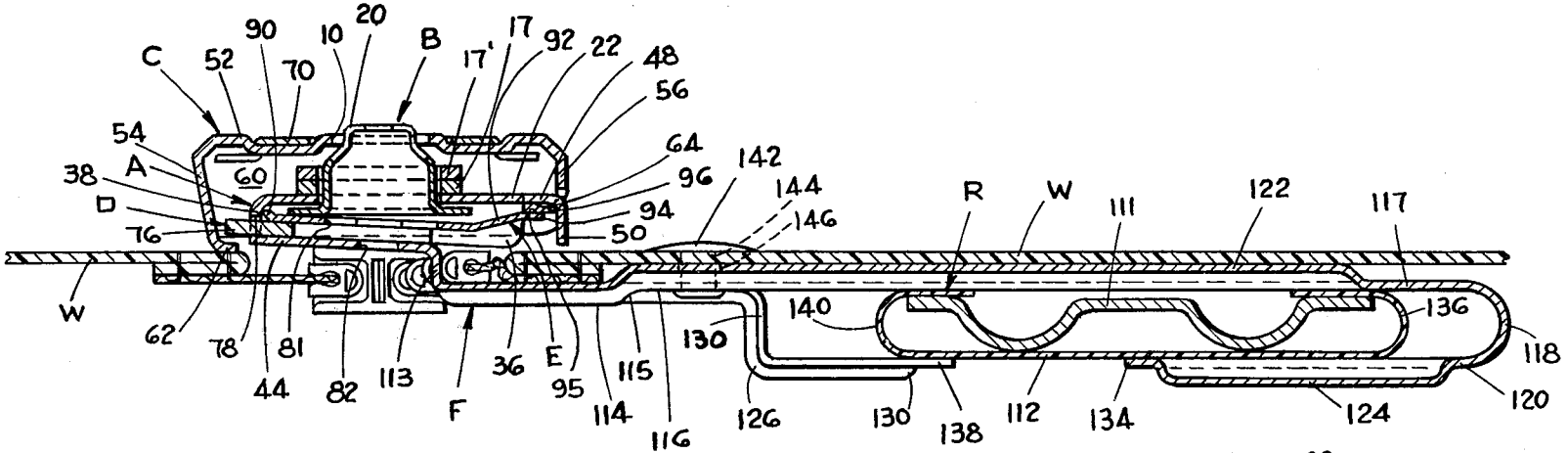
FIG. 2 is a longitudinal, vertical cross-sectional view taken approximately in the plane of line 2—2 of FIG. 1.
Figure 3:
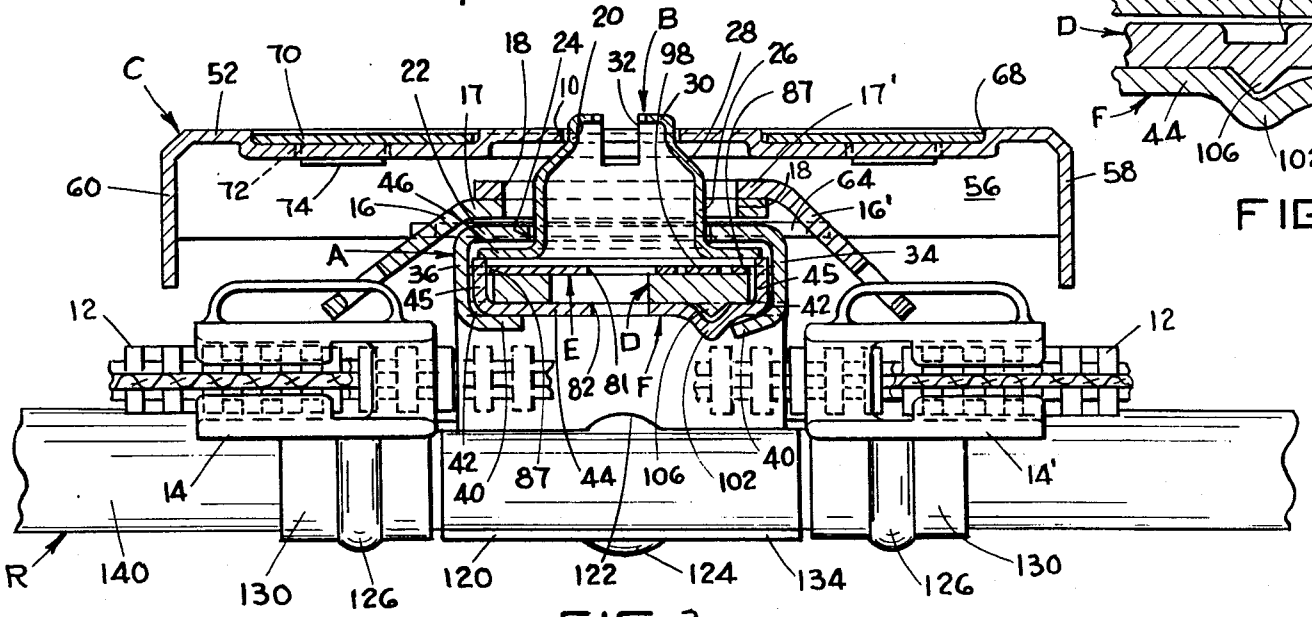
FIG. 3 is a transverse, vertical cross-sectional view taken approximately in the plane of line 3—3 of FIG. 1.

The latching device of the invention is particularly suited for use on luggage cases of the type which, as illustrated, includes a slide fastener or a zipper as the closure for the luggage case. The wall W of the case may comprise any suitable flexible material, such as fabric suitably coated with a water-proofing composition as well known in the art. As shown in FIGS. 1 and 2, the latching device may be mounted at one end of a mounting plate F, the other end of the mounting plate being engageable with a rigid reinforcing member R of the case so that key barrel B of the latching device is related to a double-acting slide fastener or zipper 12 having a pair of oppositely arranged sliders 14 and 14' with respective apertured tabs or pulls 16 and 16'. As shown in FIG. 3, end portions 17 and 17' at the free ends of tabs 16 and 16', respectively, are bent at an angle relative to the remainder of the respective tabs and are provided with an opening 18 so that the pulls in effect constitute eyeleted members which may be received by the key barrel when the sliders are in closed position adjacent frame A of the latching device.

Although a single double-acting zipper of the double-slider type is illustrated, it will be apparent that the pair of sliders 14 and 14' may be related to respective ones of a pair of one-way type zippers. In this case, the zippers lie on the same axis and each have the closed end thereof adjacent the latching device so that the openings 18 in the pulls of the sliders may be positioned over the key barrel. Also it will be apparent that the latching device is useful with a single apertured element, for example, a garment bag having a single one-way type slide fastener.

As shown in FIG. 3, the latch member C in lowered, latching position overlies base plate A and is cooperable with end portion 20 of the key barrel to prevent the zipper pulls from being disengaged from the key barrel. Thus, when the latch member is locked in lowered position by means of locking bolt D with the zipper pulls 16 and 16' over the key barrel, the zipper 12 is locked in its closed condition to thereby lock the luggage case. Moreover, the latch member has a transverse width sufficient to entirely cover the pulls and their associated sliders (FIG. 1), thereby preventing tampering with the sliders and pulls to open the luggage case.

Figure 4:
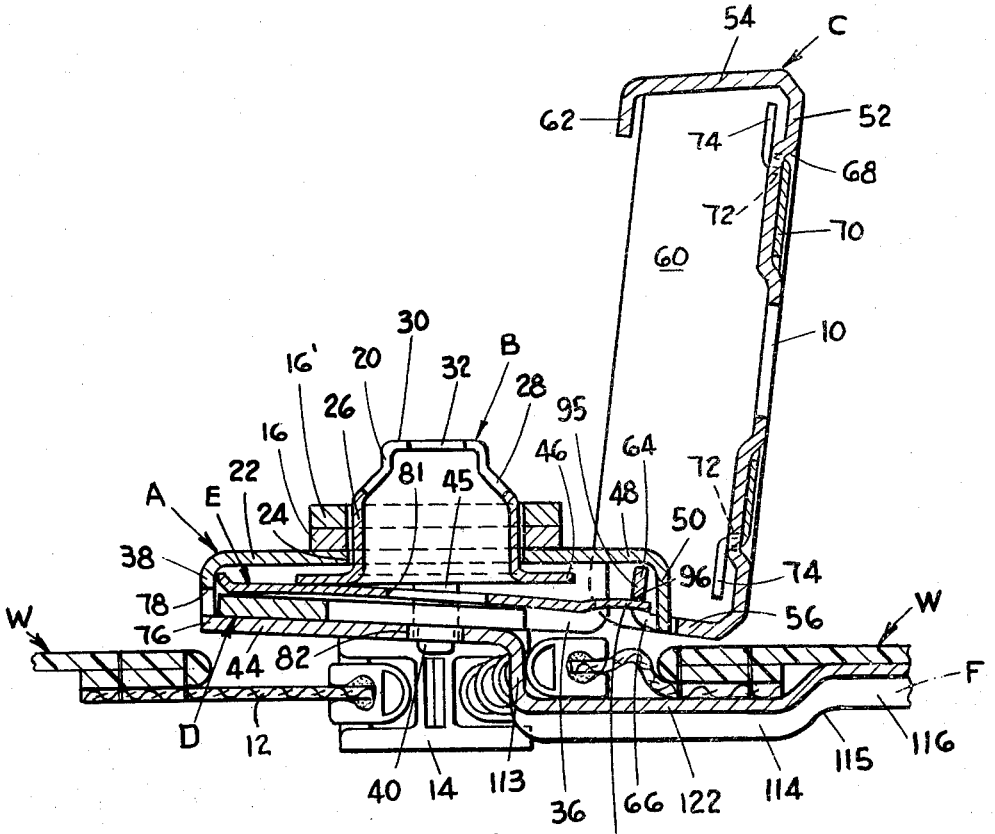
FIG. 4 is a view similar to FIG. 2, but on an enlarged scale, this view showing the latch member in unlatching position.

In great detail, and referring to FIGS. 3 and 4, frame A has a planar top wall 22 provided with a central circular opening 24 which receives the key barrel B. The key barrel is formed with a tubular portion 26, a frusto-conical portion 28, and an end portion 20 of reduced diameter which is partly closed by an end wall 30. As shown in FIG. 4, end wall 30 and wall portions 20 and 28 are cut away to provide an opening or keyhole 32 to receive a key to actuate bolt member D.

Figure 5:
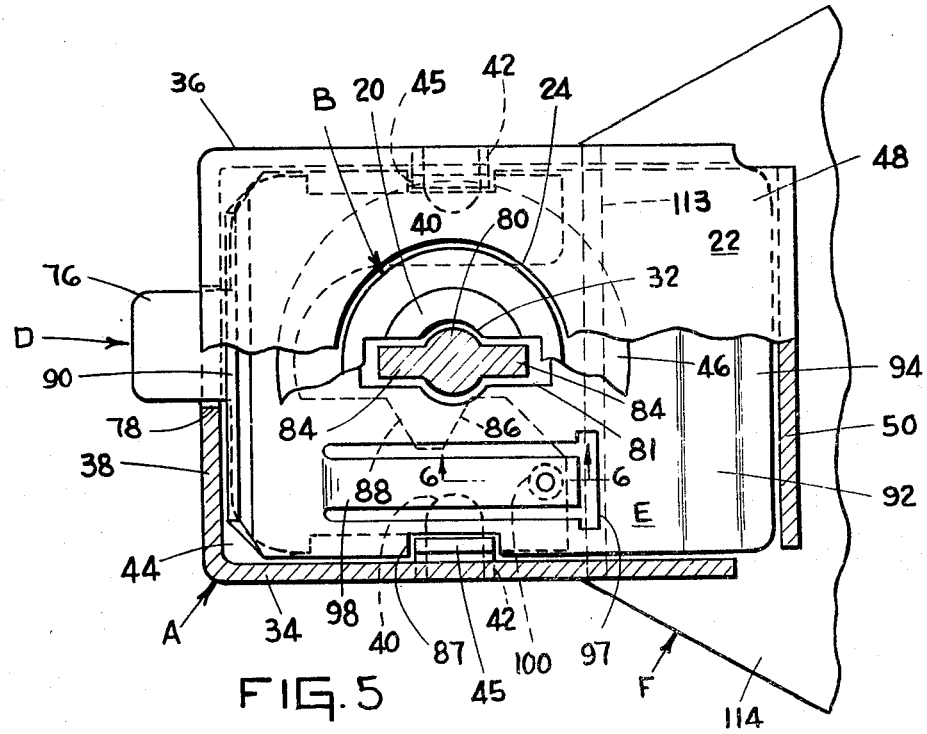
FIG. 5 is a partial top plan view of the latching device with the latch member omitted and with parts of the latching device broken away and in cross-section.

Referring to FIG. 5, a pair of transversely spaced side walls 34 and 36 depend from opposite longitudinal edges of top wall 22 of the frame A and merge with an end wall 38 which depends from a transverse edge of the top wall. As shown in FIG. 3, side walls 34 and 36 each have lugs 40 at their bottom edges. The lugs, there are two spaced lugs on each side, are received in aligned notches 42 on opposite sides of a generally rectangular, planar end portion 44 (FIG. 4) of mounting plate F and are bent over to secure the frame to the mounting plate. In the illustrated embodiment of the latching device, end portion 44 of the mounting plate, when mounted on the luggage case, is inclined at a small angle, such as 3° relative to wall W of the luggage case. Therefore, the bottom edge of each of side walls 34 and 36 is inclined at the same angle relative to top wall 22 of the frame A. As shown in FIG. 4, top wall 22 of the frame is parallel to wall W when the mounting plate is mounted on the luggage case. As shown in FIG. 3, edge portions of the mounting plate F are bent up to provide a pair of opposite upturned lugs 45. The top edges of these lugs are cooperable with an annular flange 46 at the lower end of tubular wall 26 of the key key barrel to rotatably support the key barrel in the opening 24 of the frame A.

Referring to FIG. 5, top wall 22 of the frame opposite the edge having end wall 38 is provided with an extended portion 48 having a transverse width smaller than that of the top wall of the frame. The extended portion is bent down to provide a transverse end wall 50 (FIG. 4) for a purpose to be described.

Referring to FIG. 1, latch member C has a generally rectangular top wall 52, a pair of parallel side walls 54 and 56 which depend from opposite transverse edges of the top wall and a pair of parallel side walls 58 and 60 which depend from opposite longitudinal edges of the top wall. As shown in FIGS. 2 and 3, side walls 56, 58 and 60 are perpendicular to top wall 52, whereas side wall 54 (FIG. 2) depends from the top wall at an angle slightly less than 90°. Referring to FIGS. 1 and 4, the latch member is formed so that walls 54 and 56 have centrally located lugs 62 and 64, respectively, which are bent inwardly to be parallel to top wall 52. As shown in FIG. 4, a central, transversely aligned slot 66 is provided at the junction of side wall 56 and lug 64 for receiving end wall 50 of the frame to pivotally connect the latch member to the frame. When the latch member is in the raised, unlatching position shown in FIG. 4, the zipper pulls 16 and 16' may be placed on or removed from the key barrel B. On the other hand, when the latch member is in the lowered, latching position shown in FIGS. 2 and 3, the central opening 10 in the top wall 52 of the latch member receives the reduced-diameter end portion 20 of the key barrel, thereby preventing removal of the zipper pulls from the latching device. In the illustrated embodiment of the latching device, top wall 52 of the latch member has a recess 68 (FIG. 1) which receives a decorative insert 70. As shown in FIGS. 1 and 4, the recessed portion of the top wall is provided with transverse slots 72 which receive respective tabs 74 of the insert, these tabs being bent outwardly parallel with the top wall to maintain the insert in the recess.

Bolt member D is supported and confined for sliding movement beneath flange 46 of the key barrel and between lugs 45 of the mounting plate and by end portion 44 of the mounting plate, as shown in FIG. 3. Referring to FIG. 2, when the bolt member is in locking position (FIGS. 1, 2 and 5) with the latch member in lowered position, a projection 76 at one end of the bolt member extends through a slot 78 in side wall 38 of the frame to lie over lug 62 provided by side wall 54 of the latch member, thereby releasibly locking the latch member in the lowered, latching position. To unlock the latching device, a key 80 (FIG. 5) is first inserted through opening 32 of the key barrel and through a central opening 81 in a leaf spring E to be described hereinafter, with the end of the key received in a circular opening 82 (FIG. 3) in the end portion 44 of the mounting plate. Rotation of the key in the counterclockwise direction brings a tooth 84 of the key into engagement with a surface 86 of the bolt member for moving the bolt member to the unlocking position shown in FIG. 2 and shown in phantom in FIG. 5, wherein projection 76 of the bolt member must be retracted into the frame sufficiently to enable the latch member to be moved to raised, unlatching position. After the latch member is turned to lowered position, subsequent rotation of the key in the clockwise direction brings a tooth 84 into engagement with surface 88 of the bolt member for returning the bolt member to the locking position.

Leaf spring E (FIG. 5), which has the same general outline as the top wall 22 of the frame, is held in position between flange 46 of the key barrel and the top surface of the bolt member by side walls 34 and 36 and end walls 38 and 50 of the frame (FIG. 3). Both longitudinal edges of the leaf spring have notches 87 therein to provide clearance for lugs 45 of the mounting plate. Referring to FIG. 2, an edge portion of the leaf spring adjacent side wall 38 of the frame is bent upwardly at 90 from the planar central portion of the spring to engage the underside of top wall 22 of the frame. The opposite end portion of the spring slopes upwardly at 92 and then extends outwardly a short distance to form a narrow end portion 94 which is in elevated, parallel relation with respect to the central portion of the spring. This end portion is cooperable with lug 64 at the bottom of side wall 56 of the latch member for resiliently maintaining the latch member in the lowered and raised positions shown in FIGS. 2 and 4, respectively. Specifically, and referring to FIG. 2, when the latch member is in lowered position, end portion 94 of the spring, which is in a flexed condition, is biased into engagement with bottom surface 95 of lug 64. Rotation of the latch member toward the raised position of FIG. 4 causes lug 64 to be pivoted out of parallel contact with top wall 22 of the frame, thereby moving surface 95 of the lug away from the top wall against the force of the leaf spring. Thus, the leaf spring acts to resiliently maintain the latch member in the lowered position. When the latch member has been moved fully into the raised position of FIG. 4, end portion 94 of the leaf spring snaps into parallel engagement with surface 96 of lug 64. Rotation of the latch member toward lowered position causes surface 96 to be moved against the force of the leaf spring. Thus, the leaf spring also acts to resiliently maintain the latch member in the raised position.

Figure 6:
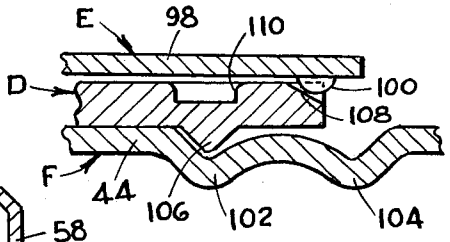
FIG. 6 is a partial, longitudinal, vertical cross-sectional view taken approximately in the plane of lines 6—6 of FIG. 5.

In addition to its function of resiliently maintaining the latch member in its respective raised and lowered positions, the spring E operates to maintain the bolt member D in its respective locked and unlocked positions. As shown in FIG. 5, the leaf spring is provided with a slot 97 which defines a spring finger 98 having a detent 100 formed on the underside near the end thereof. When spring finger 98 is in relaxed condition (i.e., before the spring is assembled in the latching device), the spring finger is inclined downwardly relative to the planar central portion of the spring. As a result, when a leaf spring is employed in the latching device as illustrated, the spring finger is flexed to bias detent 100 into contact with the top surface of the bolt member. As shown in FIG. 6, end portion 44 of the mounting plate is provided with a pair of longitudinally spaced recesses 102 and 104 which are adapted to receive a projection 106 provided on the underside of the bolt member when the bolt member is in locking and unlocking positions, respectively. Detent 100 is cooperable with an inclined surface 108 at the end and top side of the bolt member and with a recess 110 in the bolt member for releasibly maintaining the bolt member in the locking and unlocking positions, respectively.

Mounting plate F can be fastened to a wall W of a luggage case by any suitable means for mounting the latching device in the desired position. However, where the luggage case, like the illustrated luggage case, has a rigid reinforcing member R, such as a steel frame 111 having a stiff covering 112 (FIG. 2), the mounting plate may be constructed as shown to engage the reinforcing member to provide a more rigid support for the latching device. Moreover, the illustrated mounting plate enables adjustment of the distance between the frame A and the reinforcing member so that the latching device of the invention can be mounted on luggage cases of different sizes which have such members.

More specifically, and referring to FIGS. 2 and 4, the mounting plate F is formed so that a vertical wall 113 extends downwardly from a transverse edge of end portion 44 and a longitudinally extending wall 114 extends from wall 113 parallel to top wall 22 of the frame. As shown in FIG. 1, wall 114 is generally trapezoidal in shape, its transverse width increasing as it extends away from wall 113. Referring to FIGS. 2 and 4, the mounting plate is formed to extend upwardly and outwardly from wall 114 at an angle of approximately 45° to form a wall portion 115 and then extends outwardly to provide a wall 116 which is parallel to wall 114. Further, the mounting plate is formed to provide a wall portion 117, which is transversely narrower than wall 116, the wall portion 117 extending longitudinally and coplanarly away from the central portion of wall 116. The wall portion 117 is provided with an extension which is bent 180° at 118 to extend in the opposite direction to furnish a central finger 120 beneath top wall 117. The central finger and the top wall are parallel and spaced from each other by a distance approximately equal to the thickness of support frame R. As shown in FIGS. 1 and 2, wall portions 114, 115, 116 and 117 of the mounting plate may be provided with a narrow, longitudinal, upwardly projecting, central reinforcing rib 122, while the central finger 120 may be provided with a central, longitudinal, downwardly projecting reinforcing rib 124.

The mounting plate is further provided with a pair of transversely spaced extensions 126 which project downwardly perpendicularly from the transverse edges of wall at 128 on opposite sides of top wall 116 and then project outwardly to form outer fingers 130 which are parallel to the top wall. The distance between the outer fingers and the top wall is selected to be slightly greater than the thickness of the reinforcing member R. The mounting plate is further provided with downwardly projecting longitudinal ribs 132, which extend along walls 115, 116 and extensions 126 nearly to the ends of outer fingers 130.

To mount the assembly on the reinforcing member R, end 118 of the mounting plate is forced between wall W of the luggage case and the reinforcing member, and is then pushed in a direction away from zipper 12 to position top wall 117 and central finger 120 of the mounting plate between wall W and the reinforcing member. The mounting plate is pushed further in this direction until the projecting end 134 of the central finger is moved past the outer end 136 of the reinforcing member. The mounting plate is then upwardly away from the reinforcing member. The mounting plate is then pulled toward the zipper 12 to bring the end 134 of central finger 120 into engagement with the bottom surface of the reinforcing member. The mounting plate is moved in this direction until the projecting ends 138 of the outer fingers 130 are moved past the inner end 140 of the reinforcing member. At this point, the mounting plate is then pivoted downwardly to bring the top wall 117 into parallel contact with the top surface of the reinforcing member. The mounting plate is then moved in the direction away from the zipper to bring the outer fingers 130 into parallel engagement with the bottom surface of the reinforcing member. With the reinforcing member thus engaged between the top wall and the central and outer fingers of the mounting plate, the mounting plate is adjusted so that key barrel B is positioned on the center line of zipper 12. The mounting plate is secured in desired position by any suitable means, for example, a pair of rivets 142 may be inserted through aligned openings 144 and 146 (FIG. 2) in wall W of the case and in wall 116 of the mounting plate, respectively, these rivets being headed over as shown in FIG. 2 to secure the latching device in the position shown.

The mounting plate employed in the latching device of the invention therefore provides adjustment of the distance between the key barrel and the reinforcing member of the case, thereby enabling the latching device to be mounted on luggage cases having different sizes which employ such reinforcing members.

It is believed that the advantages and improved results furnished by the latching device of the invention will be apparent from the foregoing description of a preferred embodiment thereof. Various changes and modifications may be made without departing from the spirit and scope of the invention, as sought to be defined in the following claims.

I claim:

1. A latching device for releasably locking therein an element having an opening therein, the latching device comprising a frame, key-receiving means having an opening for receiving a key projecting from the frame, the key-receiving means being dimensioned to be received by the opening in the element, a latch member mounted on the frame for movement between a first position overlying the key-receiving means and a second position removed from the key-receiving means, the latch member in the first position being cooperable with the key-receiving means for preventing removal of the element from the key-receiving means, and locking means actuatable by a key inserted in the opening in the key-receiving means for movement between locking and unlocking positions, the locking means being cooperable with means provided by the latch member for releasably locking the latch member in the first position when the locking means is in locking position.

2. A latching device as set forth in claim 1, wherein the key-receiving means comprises a rotatable key barrel.

3. A latching device as set forth in claim 1, wherein the locking means comprises a bolt member supported for sliding movement between the locking and unlocking positions.

4. A latching device as set forth in claim 1, wherein the latch member is supported for pivotal movement between the first and second positions.

5. A latching device as set forth in claim 4, wherein the locking means comprises a bolt member supported below the key-receiving means for sliding movement between the locking and unlocking positions.

6. A latching device as set forth in claim 5, wherein the key-receiving means comprises a key barrel supported for rotation in an opening in the frame, the locking means being supported for sliding movement below the key barrel.

7. A latching device as set forth in claim 5, further comprising a leaf spring for resiliently maintaining the latch member in the first and second positions and for resiliently maintaining the bolt member in the locking and unlocking positions.

8. A latching device as set forth in claim 4, wherein an end portion of the key-receiving means is received in the opening in the latch member when the latch member is in the first position.

9. A latching device as set forth in claim 1, wherein the element having the opening therein is an apertured pull of a slider, and there are a pair of sliders on a zippered container to be locked together, and wherein the latching device further comprises mounting means for mounting the frame on the container.

10. A latching device as set forth in claim 9, wherein the mounting means comprises attachment means for connecting the frame to a rigid member provided by the container.

11. A latching device as set forth in claim 10, wherein the attachment means has means for enabling adjustment of the position of the frame relative to the rigid member provided by the container.

12. A latching device as set forth in claim 9, wherein the mounting means comprises a mounting plate having means at one end for connection to the container, and having its other end attached to the frame; and wherein the locking means comprises a bolt member supported by said other end of the mounting plate for sliding movement between the locking and unlocking positions.

13. A latching device as set forth in claim 12, further comprising a leaf spring for biasing the bolt member against said other end of the mounting plate, and wherein the bolt member and said other end of the mounting plate have cooperable means for resiliently maintaining the bolt member in the locking and unlocking positions under the urging of the leaf spring.

14. A latching device as set forth in claim 13, wherein the latch member is supported for pivotal movement between the first and second positions, and wherein the leaf spring provides means for releasably maintaining the latch member in the first and second positions.

15. A latching device as set forth in claim 12, wherein the key-receiving means comprises a key barrel, and wherein the key barrel is supported for rotation in an opening in the frame by means provided by said other end of the mounting plate.

16. A latching device as set forth in claim 14, wherein the key-receiving means comprises a key barrel, and wherein the key barrel is supported for rotation in an opening in the frame by means provided by said other end of the mounting plate.

* * * * *